US011435061B2

(12) United States Patent
Zhang et al.

(10) Patent No.: US 11,435,061 B2
(45) Date of Patent: Sep. 6, 2022

(54) DIRECT-TYPE PANEL LAMP

(71) Applicant: CH LIGHTING TECHNOLOGY CO., LTD., Shaoxing (CN)

(72) Inventors: Junyu Zhang, Shaoxing (CN); Zegang Hang, Shaoxing (CN); Jizhong Pu, Shaoxing (CN)

(73) Assignee: CH LIGHTING TECHNOLOGY CO., LTD., Shaoxing (CN)

( * ) Notice: Subject to any disclaimer, the term of this patent is extended or adjusted under 35 U.S.C. 154(b) by 0 days.

(21) Appl. No.: 17/172,020

(22) Filed: Feb. 9, 2021

(65) Prior Publication Data

US 2022/0136680 A1 May 5, 2022

(30) Foreign Application Priority Data

| | | |
|---|---|---|
| Oct. 29, 2020 | (CN) | 202022457220.0 |
| Oct. 29, 2020 | (CN) | 202022458501.8 |
| Oct. 29, 2020 | (CN) | 202022459354.6 |
| Oct. 29, 2020 | (CN) | 202022459389.X |
| Oct. 29, 2020 | (CN) | 202022461228.4 |

(51) Int. Cl.

| | |
|---|---|
| ***F21V 17/06*** | (2006.01) |
| ***F21V 15/01*** | (2006.01) |
| ***F21V 5/00*** | (2018.01) |
| ***F21Y 105/16*** | (2016.01) |
| ***F21Y 115/10*** | (2016.01) |

(52) U.S. Cl.

CPC ..... *F21V 17/06* (2013.01); *F21V 5/007* (2013.01); *F21V 15/01* (2013.01); *F21Y 2105/16* (2016.08); *F21Y 2115/10* (2016.08)

(58) Field of Classification Search

CPC ..... F21V 17/06; F21V 15/01; F21Y 2105/16; F21Y 2115/10; F21S 8/04; F21S 8/043; F21S 8/046; F21S 8/06; G02F 1/133603; G02F 1/133608

See application file for complete search history.

(56) References Cited

U.S. PATENT DOCUMENTS

| | | | | |
|---|---|---|---|---|
| 2014/0240978 | A1* | 8/2014 | Kim | F21V 15/01 362/235 |
| 2015/0055353 | A1* | 2/2015 | Hutchens | F16M 13/02 362/370 |
| 2017/0009960 | A1* | 1/2017 | Ahn | G02F 1/133603 |

FOREIGN PATENT DOCUMENTS

| | | | | |
|---|---|---|---|---|
| CN | 102518997 A | * | 6/2012 | G02F 1/133606 |
| KR | 101177481 B1 | * | 8/2012 | F21V 21/03 |

(Continued)

*Primary Examiner* — Erin Kryukova

(57) ABSTRACT

A direct-lit panel light including a frame, a diffusion plate, a back plate and at least one light bar. The frame comprises a plurality of frame bars that are connected end-to-end, each frame bar having a first mounting surface and a second mounting surface; the diffusion plate is overlapped on the first mounting surface, the back plate is overlapped on the second mounting surface, and the center area of the back plate is fixed with the at least one light bar, and the edge area of the back plate is deformed and forms first convex ribs extending along peripheral sides of the back plate, and the first convex ribs abut against the diffusion plate and press it against the first mounting surface, and the first convex rib on each peripheral side of the back plate has a height gradually increasing from the middle thereof towards two ends thereof, respectively.

20 Claims, 16 Drawing Sheets

(56) References Cited

FOREIGN PATENT DOCUMENTS

| | | | | |
|---|---|---|---|---|
| KR | 20120104047 | A | * | 9/2012 |
| KR | 101459096 | B1 | * | 11/2014 |

* cited by examiner

DIRECT-TYPE PANEL LAMP

TECHNICAL FIELD

This application relates to the technical field of panel lamps, particularly to a direct-type panel lamp.

BACKGROUND

LED panel lamp has the advantages of good uniformity of illumination, soft and comfortable light, environmental protection materials, and low power consumption, which is currently a popular indoor lighting fixture.

In general, the panel lamp includes a frame, a back plate, a diffusion plate, a driving power supply, and multiple light-emitting components, wherein the back plate is installed on the back side of the frame, the diffusion plate is installed on the front side of the frame, the light-emitting components are placed between the back plate and the diffusion plate and installed on the bottom surface of the back plate, and the driving power supply is installed on the side of the panel lamp facing away from the light-emitting side. The light from the light-emitting component passes through the diffusion plate with high light transmittance to become a uniform planar light, and the driving power supply functions to drive the light-emitting component.

When the panel lamp is installed on the keel of the ceiling, the weight of the light-emitting components is directly exerted on the back plate, causing the middle of the back plate to sag downward and the edge of the back plate to turn up, so that the frame may deform and warp under the pulling of the edge of the back plate, which results that the panel lamp cannot be placed flat on the keel.

SUMMARY

In order to solve the above-mentioned problems, the present application provides a direct-type panel lamp, which can avoid the deformation of the frame. This application provides a direct-type panel lamp, including:

at least one light bar, the light bar includes a substrate and LED lamp beads fixed on the substrate;

a frame, including several frame bars that are connected end-to-end, each frame bar having a first mounting surface and a second mounting surface that are located at different levels;

a diffusion plate for transmitting light, wherein an edge of the diffusion plate is overlapped on the first mounting surface at a lower level; and a back plate, the back plate is a shell-like structure formed by deforming a sheet metal, the edge area of which is overlapped on the second mounting surface at the higher level, and the center area is arched and configured to install and fix the light bar, the edge area of the back plate is deformed and forms first convex ribs extending along peripheral sides of the back plate, the first convex ribs abut against the edge of the diffusion plate press it against the first mounting surface, and the first convex rib on each peripheral side of the back plate has a height gradually increasing from a middle thereof towards two ends thereof, respectively.

As the height of the first convex ribs at different positions slightly changes, so after installation, although the corner portions of the back plate may turn up, since the gap that may be caused by the rising has been pre-occupied by the first convex ribs, it is possible to avoid pulling on the frame, keeping the frame flat and smoothly fitting with the keel. Based on the same inventive idea, the present application also provides similar alternative solutions. And of course, different solutions also have additional technical effects.

This application provides a direct-type panel lamp, including:

at least one light bar, the light bar comprising a substrate, LED lamp beads fixed on the substrate, and lenses covering the LED lamp beads;

a frame, including several frame bars that are connected end-to-end, each frame bar having a first mounting surface and a second mounting surface that are located at different levels;

a diffusion plate for transmitting light, wherein an edge of the diffusion plate is overlapped on the first mounting surface at a lower level; and a back plate having a shell-like structure formed by deforming a sheet metal, wherein an edge area of the back plate is overlapped on the second mounting surface at a higher level, and a center area of the back plate is arched and fixed with the at least one light bar;

a compensation bar, the compensation bar is arranged between the edge area and the second mounting surface, close to the corner of the frame, the thickness of the compensation bar gradually decreases from the end of the frame bar to the center.

In the present embodiment, due to the thickness change of the compensation bar, it can pre-occupy the gap caused by the deformation of the backplane in a corresponding extent to avoid the pulling of the frame by the deformed back plate, and keep the bottom surface of the frame and the keel flat and fit.

The present application provides a direct-type panel lamp, including:

at least one light bar, the light bar comprising a substrate, LED lamp beads fixed on the substrate, and lenses covering the LED lamp beads;

a frame, including several frame bars that are connected end-to-end, each frame bar having a first mounting surface and a second mounting surface that are located at different levels;

a diffusion plate for transmitting light, wherein an edge of the diffusion plate is overlapped on the first mounting surface at a lower level; and a back plate having a shell-like structure formed by deforming a sheet metal, wherein an edge area of the back plate is overlapped on the second mounting surface at a higher level, and a center area of the back plate is arched and fixed with the at least one light bar. An included angle is provided between the portion of the edge area overlapping the second mounting surface and the second mounting surface, so that the distance between the edge area and the second mounting surface gradually decreases from the end of the frame bar towards the center of the frame bar.

In this embodiment, due to the included angle, it is equivalent to the pre-deformation of the plate, which reduces the traction of the back plate to the frame to keep the bottom surface of the frame and the keel flat and fit.

Several alternatives are also provided below, but they are not intended as additional limitations to the above-mentioned overall schemes, but merely further additions or preferred embodiments. On the premise that there is no technical or logical contradiction, each alternative embodiment can be combined separately for the above-mentioned. overall scheme, or a combination of multiple alternative manners.

Alternatively, one of the compensation bar and the second mounting surface is provided with a positioning groove, and the other is provided with a positioning pin engaged with the positioning groove.

Alternatively, the positioning pin comprises a length direction, and the outer circumference of the positioning pin is gradually contracted from one end to the other end along the longitudinal direction.

Alternatively, the compensation bar was L-shaped, comprising a first compensation portion and a second compensation portion, the connection between the first compensation portion and the second compensation portion is aligned with the connection of two adjacent frame bars, and respectively extends in the direction of the center of the frame bars;

The thickness of the first compensation portion and the thickness of the second compensation portion gradually decrease from the end of the frame bar to the center of the frame bar.

Alternatively, the positioning pins are arranged on the compensation bar, the number of the positioning pins is at least two, and each positioning pin is sequentially arranged along the extension direction of the compensation bar.

Alternatively, the included angle between the top surface and the bottom surface of the compensation bar ranges from 1 degree to 5 degrees.

Alternatively, the height of the thickest part of the compensation bar is provided as H1, and the height of the thinnest part is provided as H2, and wherein H1 and H2 meet H1: H2=1.1-2.

Alternatively, two first convex ribs located on adjacent peripheral sides of the back plate are connected with each other.

Alternatively, the highest height of the first convex rib is provided as H1, and the lowest height is provided as H2, and wherein H1 and H2 meet H1: H2=1.02~1.1: 1.

Alternatively, the distance between the first convex ribs and the edge of the back plate is 4 mm to 10 mm.

Alternatively, the back plate is arched to form a chamber comprising a flat bottom wall and inclined side wall, the bottom wall and the diffusion plate are arranged in parallel, and the at least one light bar is fixed on the bottom wall, the side wall is tangentially connected with the first convex ribs.

Alternatively, the bottom wail defines grooves arranged in a crisscross pattern for receiving the at least one light bar.

Alternatively, the edge area of the back plate forms the second convex ribs extending along the peripheral sides of the back plate, the first convex rib and the second convex rib are arranged in parallel, and the second convex ribs are located outside the first convex ribs.

Alternatively, the edge area of the back plate is bent to form the first convex ribs and the second convex ribs.

Alternatively, the cross section of the first convex ribs and the cross section of the second convex ribs are both U-shaped structures, and the opening directions of the two U-shaped structures are opposite to each other.

Alternatively, the height of a first convex rib is L1 and the width is L2, the height of a second convex rib is L3 and the width is L4, and L3=3~10, L2: L4=3~10.

Alternatively, the first convex rib and the second convex rib are arranged in parallel, the second convex ribs are located outside the first convex ribs, and the distance between the first convex ribs and the edge of the back plate is 4 mm to 10 mm.

Alternatively, the second convex ribs intervals or continuously extending along the peripheral sides of the back plate.

Alternatively, the included angle formed by the portion of the edge area overlapping the second mounting surface and the second mounting surface gradually decreases from the end of the frame to the center of the frame.

Alternatively, the maximum included angle between the portion of the edge area overlapping the second mounting surface and the second mounting surface is θ1, and the minimum included angle is θ2, and θ1:θ2=1.1~1.5: 1.

Alternatively, the included angle between the portion of the edge area overlapping the second mounting surface and the second mounting surface ranges from 3 degrees to 10 degrees.

Alternatively, the interference between the first convex ribs and the diffusion plate relative to the thickness of the diffusion plate is less than 0.5 mm.

Alternatively, the interference between the first convex ribs and the diffusion plate relative to the thickness of the diffusion plate is less than 0.3 mm.

Optionally, a cross section of the frame bar is an L-shaped structure, including a horizontal portion and a vertical portion. A corner of the frame bar is thickened inside to form a thickened portion, and the horizontal portion has a stepped structure such that the horizontal portion forms the first mounting surface and the second mounting surface that are located at different levels. The first convex ribs of the direct-lit panel lamp of the present application can increase the support strength of the entire back plate, especially the support strength of the edge area, when the direct-light panel lamp is installed on the ceiling, the deformation of the edge area can be reduced to prevent it from pulling on the frame and deform the frame, so that the direct-type panel lamp is in contact with the keel on the ceiling without gaps.

Figure 1:
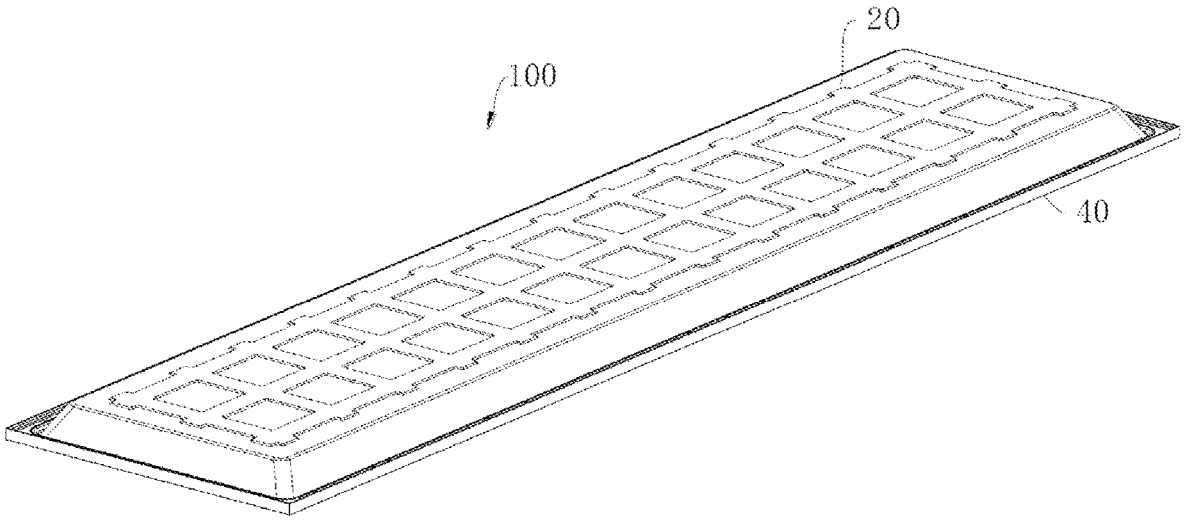
FIG. 1 is a structure view of an embodiment of a direct-type panel lamp of the present invention.

The reference signs in the figures are explained as follows:

100. direct-type panel lamp;

10. light bar; 11, substrate; 111, metal layer; 112, insulating layer; 113, circuit layer; 114, second openings; 115, solder pads; 12, LED lamp beads; 13, lenses; 131, protruding legs; 14, flexible strip; 141, first openings; 142, insulating layer; 143, circuit layer; 144, solder resist layer;

20, back plate; 21, center area; 211, projection; 22, edge area; 23, chamber; 231, bottom wall; 232, side wall; 24, first convex rib; 25, second convex ribs; 26, convex rib;

30. diffusion plate;

40. frame; 41. frame bar; 42. first mounting surface; 43. second mounting surface; 44. horizontal portion; 45. vertical portion; 46. thickened portion; 47. vertical portion; 471. screw groove;

50. driving box;

60. compensation bar; 61. positioning pin; 62. first compensation portion; 63. second compensation portion.

DESCRIPTION OF THE EMBODIMENTS

The technical solutions according to the embodiments of the present disclosure will be described apparently and completely below with reference to the drawings according to the embodiments of the present disclosure. Obviously, the described embodiments are illustrated as a part of the embodiments of the present disclosure, but not exhaustive. Based on the embodiments of the present disclosure, all other embodiments obtained by a person skilled in the art without inventive efforts fall within the protection scope of the present disclosure.

It should be noted that, when a component is "connected" with another component, it may be directly connected to another component or may be indirectly connected to another component through a further component. When a component is "provided" on another component, it may be directly provided on another component or may be provided on another component through a further component.

Unless otherwise defined, all technical and scientific terms used herein have the same meaning as commonly understood by a person skilled in the art. The terms in the description of the present disclosure functions to describe specific embodiments, and not to limit the present disclosure. The terms "and/or" used herein are intended to include one or more of the correspondingly listed options.

As shown in FIGS. 1 to 5, the present application provides a direct-type panel lamp 100, which includes a frame 40, a back plate 20, a diffusion plate 30, and at least one light bar 10. The back plate 20 has a shell-like structure formed by deforming a sheet metal, and the shell-like structure includes a center area 21 and an edge area 22 surrounding the center area 21. The center area 21 is arched to increase the distance to the diffusion plate 30 and is configured to install and fix the light bar 10.

The light bar 10 includes a substrate 11, LED lamp beads 12 fixed on the substrate 11 and lenses 13 respectively covered on the LED lamp beads 12. The light bar 10 is fixed on the side of the center area 21 of the back plate 20 facing the diffusion plate 30. The diffusion plate 30 has a light-transmitting function. The light emitted by the LED lamp beads 12 passes through the lenses 13 and the diffusion plate 30 in sequence and diffused by the later, so that LED point light sources become a uniform planar light source.

The frame 40 is formed by connecting several (usually four) frame bars 41 end-to-end. Each frame bar 41 has a first mounting surface 42 and a second mounting surface 43 which are located at different levels. The edge of the diffusion plate 30 overlaps on the first mounting surface 42 at the lower level, and the edge area 22 of the back plate 20 overlaps on the second mounting surface 43 at the higher level and is fixed by fastening screws.

As mentioned above, the back plate 20 is made of a sheet metal, and the light bar 10 is installed in the center area of the back plate 20. In the influence of gravity, the center area of the back plate 20 may sag, causing the corners of the back plate 20 to turn up. In the case where the strength of the frame is insufficient, the frame may be pulled to deform and warp.

To solve this technical problem, in some embodiments, as shown in FIGS. 6 to 11, the edge area 22 of the back plate 20 is deformed and forms first convex ribs 24 extending along the peripheral sides of the back plate 20. The first convex ribs 24 can increase the support strength of the entire back plate 20, especially the support strength of the edge area 22. During installing the direct-type panel lamp 100 on the ceiling, the deformation of the edge area 22 can be reduced, so that the edge area 22 is always in a flat state, so as to prevent it from pulling the frame 40 and thus deforming the frame 40. Therefore, the direct-type panel lamp 100 can be closely attached to the keel on the ceiling, without gap therebetween.

Figure 11:
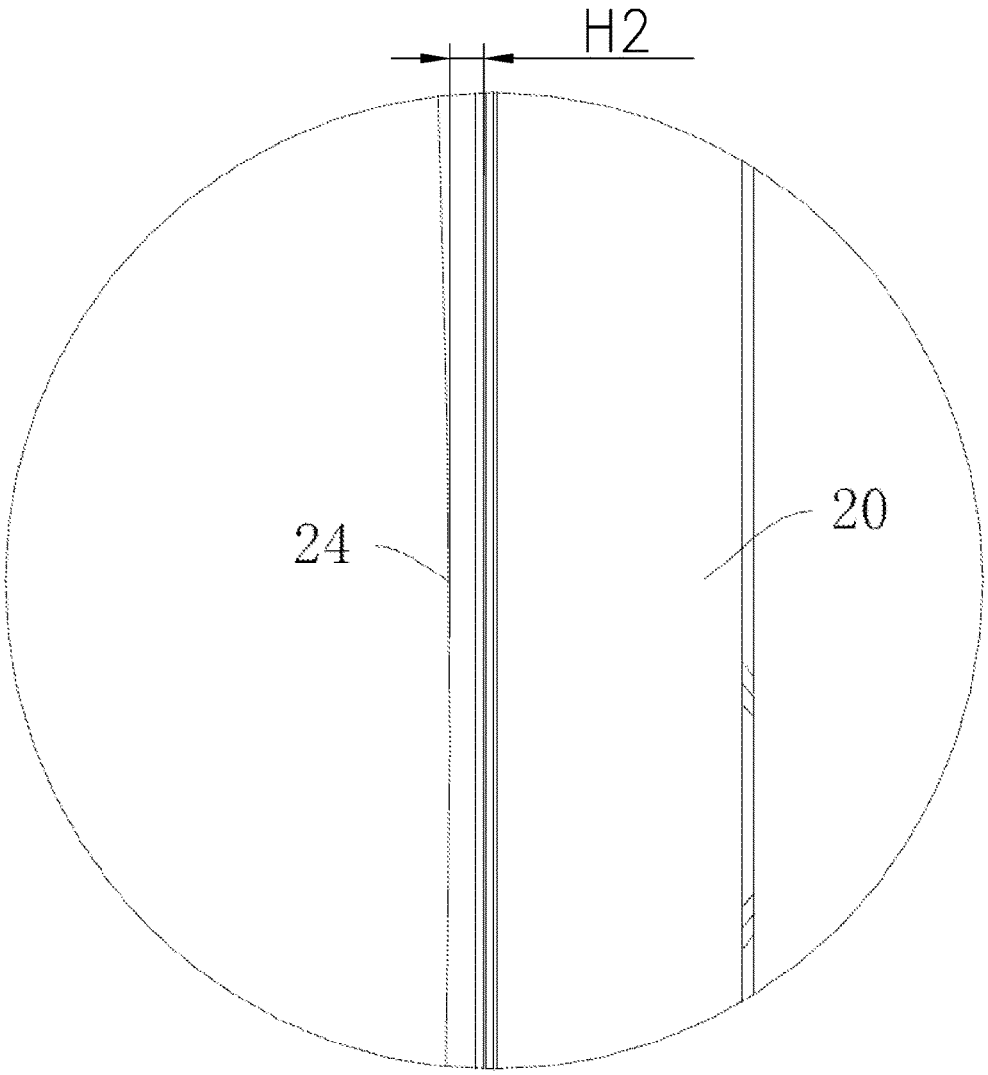
FIG. 11 is an enlarged view of the portion D shown in FIG. 9.

The first convex ribs 24 press the edge of the diffusion plate 30 to abut against the first mounting surface 42. Since the back plate 20 has a certain elasticity, when the first convex ribs 24 abut against the diffusion plate 30, the first convex ribs 24 are elastically deformed, such that the first convex ribs 24 exert pressure on the diffusion plate 30. The edge of the diffusion plate 30 is sandwiched between the first convex ribs 24 and the first mount surface 42 to avoid deformation, so that the central part of the diffusion plate (the geometric center of the diffusion plate 30 or the part around the geometric center of the diffusion plate 30) is prevented from sagging downward. The deformation of the back plate 20 is always inevitable, which can be reduced by providing a plurality of convex ribs. In order to further reduce the deformation of the back plate 20, as shown in FIG. 11, and the first convex rib 24 on each peripheral side of the back plate 20 has a height gradually increasing from a middle thereof towards two ends thereof, respectively, so as to counteract the deformation of the back plate 20. In some embodiments, two first convex ribs 24 on adjacent peripheral sides of the back plate 20 are connected with each other.

In order to avoid the situation where the first convex ribs 24 are pressed against the diffusion plate 30, with a gap therebetween (For example, caused by a too great height difference between the greatest height and the smallest height of the first convex rib 24), or with a deformation of the back plate 20 that cannot be counteracted (for example, caused by a too small height difference between the greatest height and the smallest height of the first convex rib 24), in some embodiments, the highest height of the first convex rib 24 is provided as H1, and the lowest height of the first convex rib 24 is provided as H2, wherein H1 and H2 meet H1: H2=1.02~1.1:1.

Preferably, H1: H2=1.05~1.08: 1. In the present embodiment, the height of the highest height of the first convex rib 24 is 4.2 mm, and the lowest height of the first convex rib 24 is 4 mm.

Similarly, in order to solve the problem of the deformation of the frame, in some embodiments, included angles are provided between the portion of the edge area 22 overlapping the second mounting surface 43 and the second mounting surface 43, and the included angles gradually decrease from a respective end of the frame bar 41 to the middle of the frame bar 41, which can also counteract the deformation of the back plate 20.

The maximum included angle between the portion of the edge area 22 overlapping the second mounting surface 43 and the second mounting surface 43 is provided as θ1, and the minimum included angle between the portion of the edge area 22 overlapping the second mounting surface 43 and the second mounting surface 43 is provided as θ2, wherein θ1 and θ2 meet: θ1:θ2=1.1~1.5:1, preferably, θ1:θ2=1.1~1.3:1. In the present embodiment, θ1 is 5 degrees, and θ2 is 4 degrees.

Specifically, the included angle between the portion of the edge area 22 overlapping the second mounting surface 43 and the second mounting surface 43 ranges from 3 degrees to 10 degrees. Preferably, the included angle between the portion of the edge area 22 overlapping the second mounting surface 43 and the second mounting surface 43 ranges from 3 degrees to 8 degrees.

In the case where the first convex ribs 24 are pressed against the diffusion plate 30 too tightly, the back plate 20 is more likely to pull the frame to warp. In order to solve this problem, in some embodiments, the interference (for example, denoted as X in FIG. 6) of the distance between the first convex ribs 24 and the diffusion plate 30 relative to the thickness of the diffusion plate is less than 0.5 mm, wherein the pressure from the back plate 20 to the diffusion plate 30 ranges from 0 to 100 N.

Preferably, the interference of the distance between the first convex ribs 24 and the diffusion plate 30 relative to the thickness of the diffusion plate is less than 0.3 mm, such that the pressure from the back plate 20 to the diffusion plate 30 is controlled within 0 to 50N.

In order to further avoid deformation and warpage of the frame, in some embodiments, as shown in FIGS. 6 to 10, the edge area 22 of the back plate 20 forms second convex ribs 25 extending along the peripheral sides of the back plate 20. The second convex ribs 25 and the first convex ribs 24 cooperate with each other to increase the supporting strength of the entire back plate 20, especially the supporting strength of the edge area 22. During installing the direct-type panel lamp 100 on the ceiling, the deformation of the edge area 22 can be reduced, so that the edge area 22 is always in a flat state. It is prevented from pulling and thus deforming the frame 40, so that the direct-type panel lamp 100 can be closely attached to the keel on the ceiling, without gap therebetween.

In some embodiments, in order to reduce the processing difficulty of the first convex ribs 24 and the second convex ribs 25, the edge area 22 is bent to form the first convex ribs 24 and the second convex ribs 25. The edge area 22 is bent using conventional processing methods, such as mechanical stamping or the like.

In some embodiments, the first convex rib 24 and the second convex rib 25 are arranged in parallel, and the second convex ribs 25 are located outside of the first convex ribs 24 to facilitate the installation of the back plate.

In some embodiments, the frame bars 41 are made of metal profile (such as aluminum alloy), and the adjacent ends of the adjacent frame bars 41 are welded and fixed. Alternatively, the frame bars 41 may be formed by injection molding polymer materials. In this case, since polymer materials cannot be welded, it is generally necessary to provide corner pieces at the corners of the frame 40 to connect adjacent frame bars 41. Alternatively, adjacent frame bars 41 may be connected by overlapping and connecting with each other. However, the flatness of a frame 40 made of polymer materials is poorer than that of a frame 40 made of metal profile.

Figure 12:
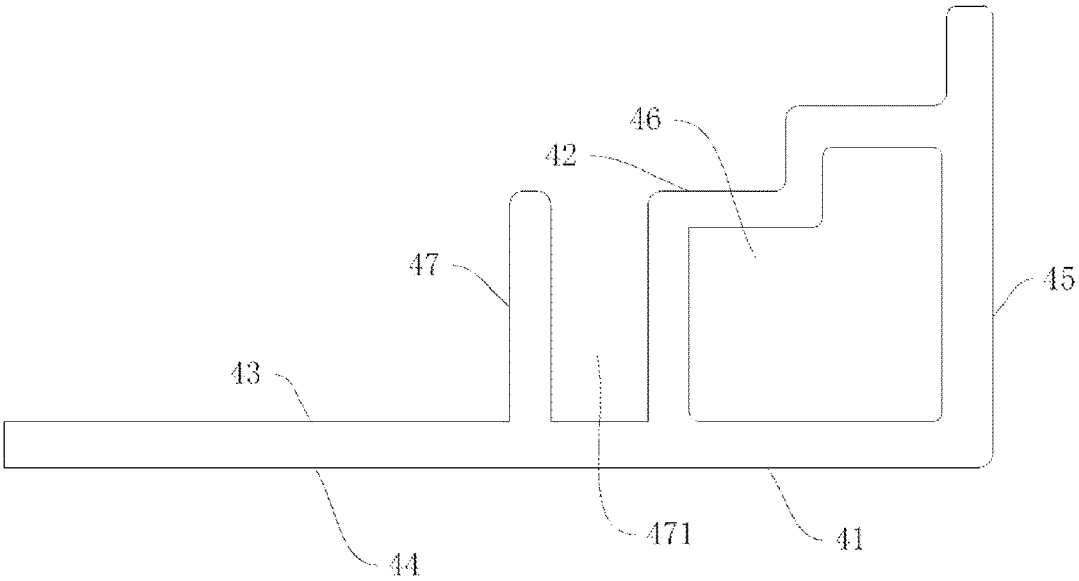
FIG. 12 is a structure view of the frame bar shown in FIG. 1.
Figure 13:
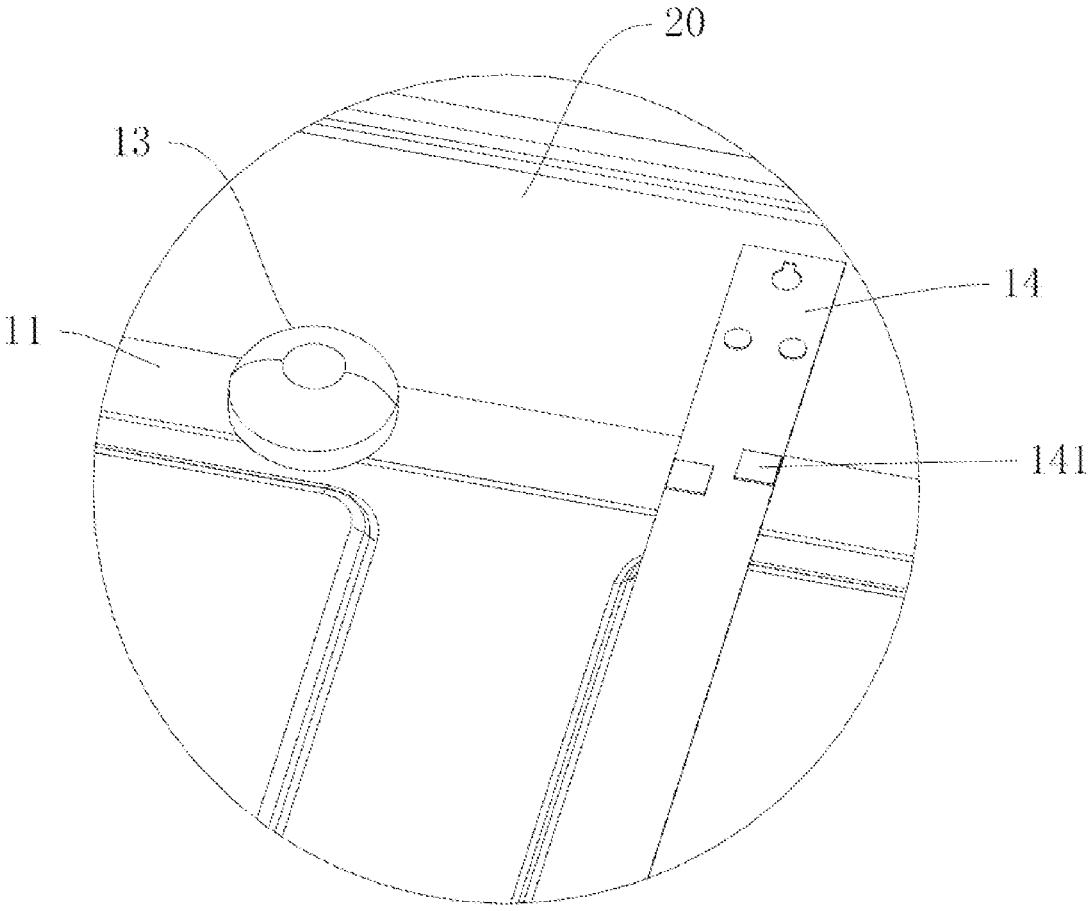
FIG. 13 is a structure view showing an arrangement for connecting the light bars.
Figure 14:
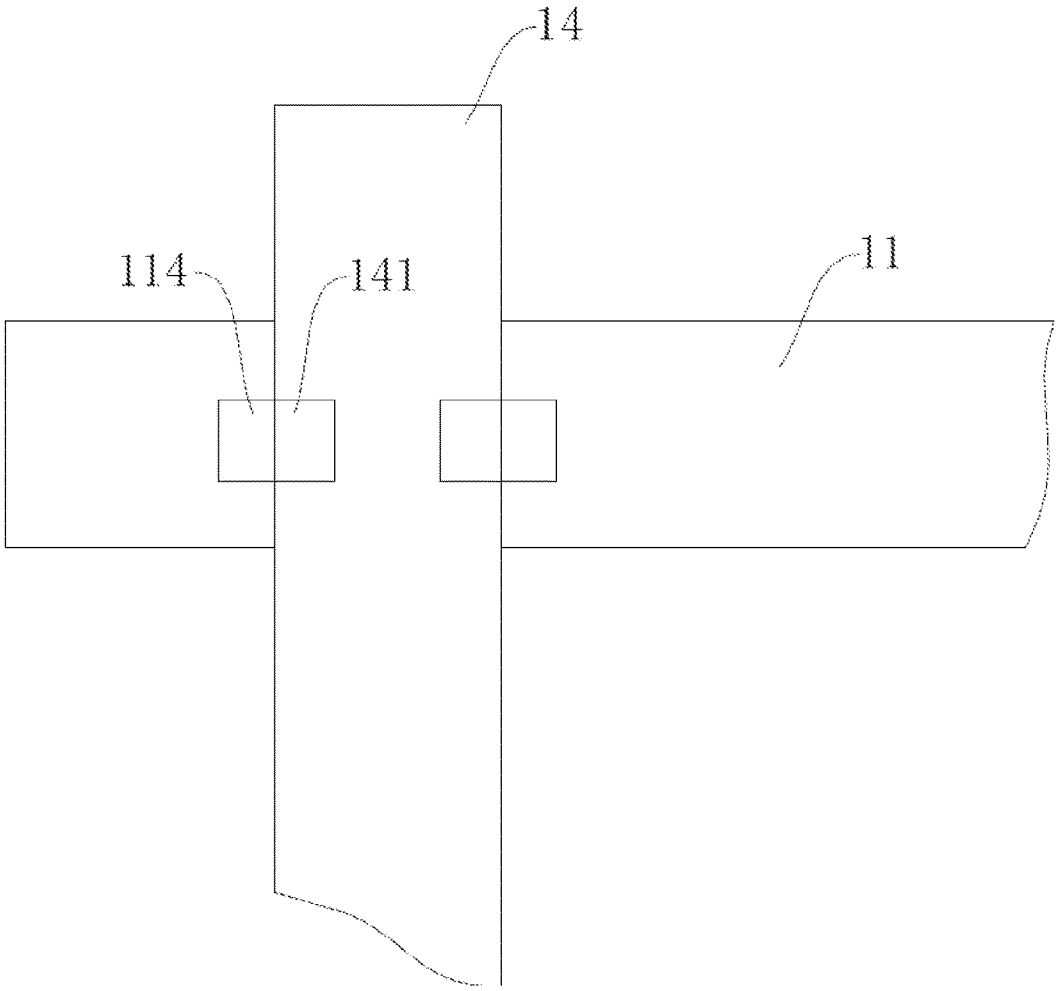
FIG. 14 is a structure view of the flexible strip being connected with the substrate in FIG. 13.
Figure 15:
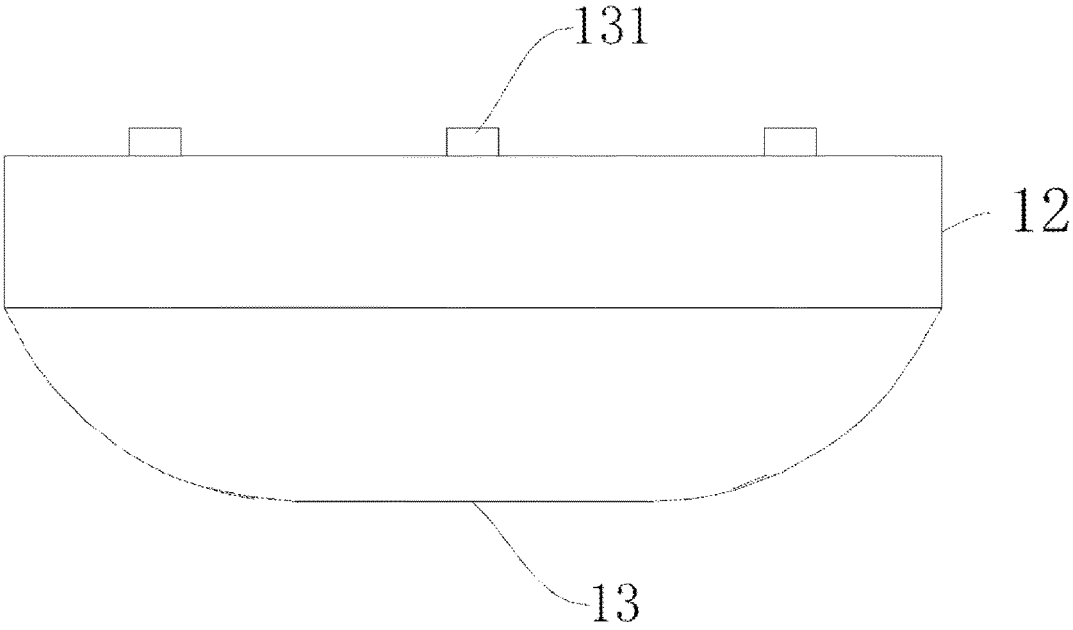
FIG. 15 is a structure view of the LED lamp beads and the lenses in FIG. 13.
Figure 16:
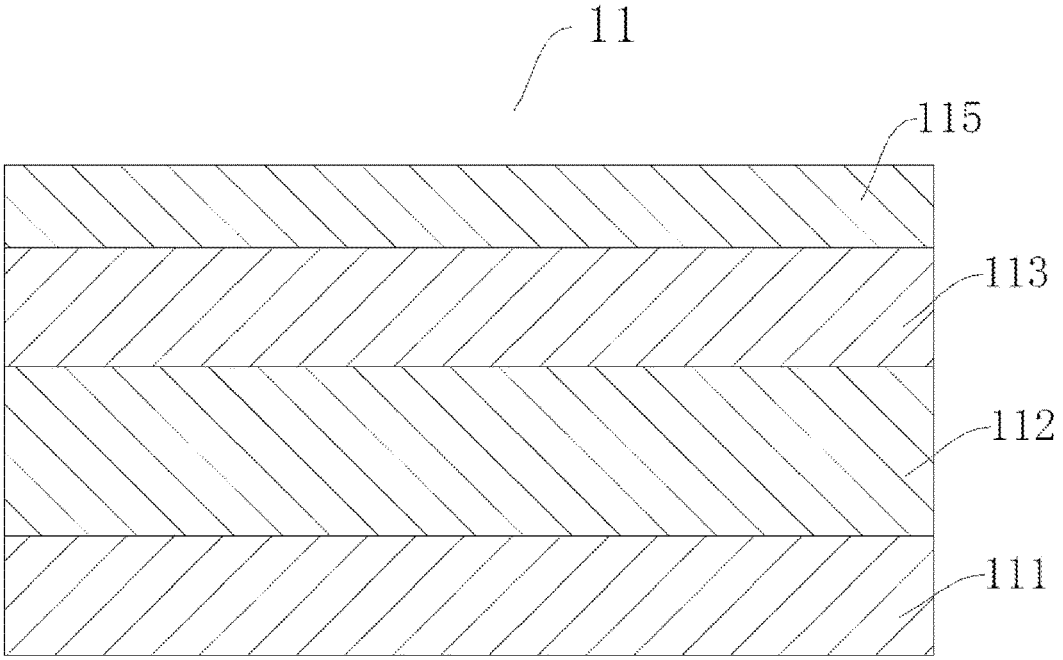
FIG. 16 is a structure view of the substrate in FIG. 13.
Figure 17:
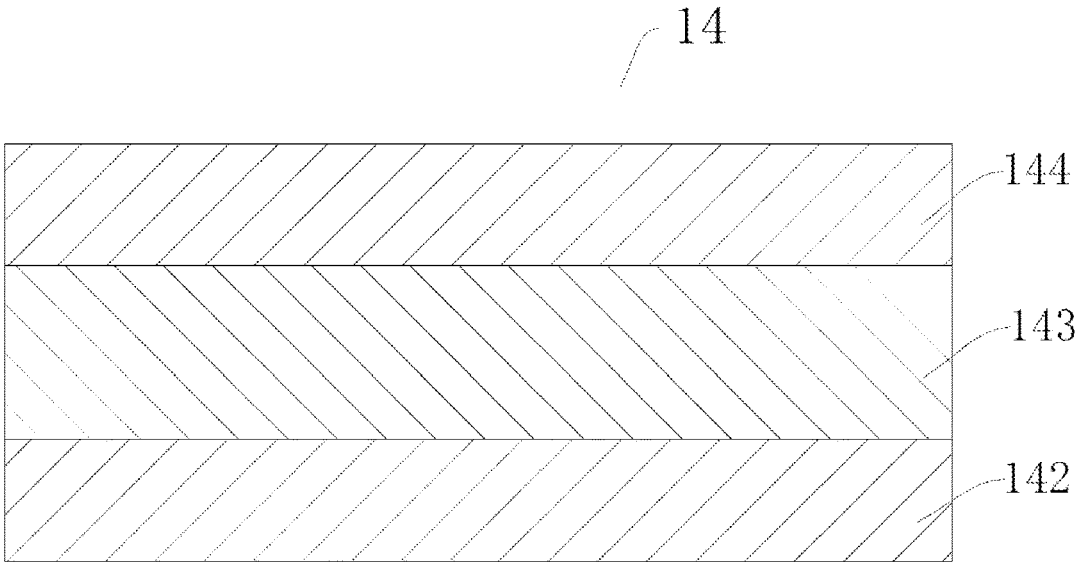
FIG. 17 is a structure view of the flexible strip in FIG. 13.
Figure 18:
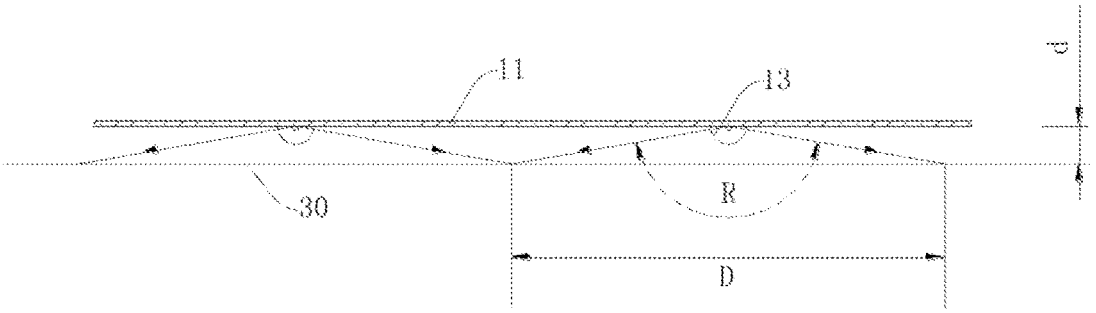
FIG. 18 is a structure view showing the light emitted by the LED lamp beads passing through the lenses and being diffused.

In some embodiments, as shown in FIG. 12, the frame bar 41 has an L-shaped cross section, and includes a horizontal portion 44 and a vertical portion 45. The edge of the diffusion plate 30 and the edge of the back plate 20 are both overlapped on the horizontal portions 44. The vertical portion 45 encloses a confined space, and functions to shield the structure of the back plate 20 at the edge and have a decorative and protective effect.

In some embodiments, in order to increase the strength of the profile, the thickness of the corner of the frame bar 41 is increased inside to form a thickened portion 46, thereby forming a stepped structure at the horizontal portion 44. The first mounting surface 42 and the second mounting surface 43 are provided on the stepped structure and the horizontal portion 44 respectively. In order to save material, in some embodiments, the thickened portion may have a hollow structure.

In some embodiments, both the first convex rib 24 and the second convex rib 25 have a U-shaped cross section, and the two U-shaped structures are opened to opposite directions.

In the present embodiment, in the case where the direct-type panel lamp 100 is in the installed state, the U-shaped structure of the first convex rib 24 opens upward, and the U-shaped structure of the second convex rib 25 opens downward.

In order to allow the first convex ribs 24 to be elastically deformed when they abut against the diffusion plate 30, and to reduce the deformation of the second convex ribs 25, the height of the first convex rib 24 is L1 and the width thereof is L2, the height of the second convex rib 25 is L3, and the width thereof is L4, and L1: L3=3-10, L2: L4=3-10.

Preferably, L1: L3=3~10, L2: L4=3~10. In the present embodiment, the height of the first convex rib 24 is 4.2 mm and the width thereof is 2.3 mm; the height of the second convex rib 25 is 0.6 mm and the width thereof is 0.7 mm.

It should be noted that, in the case where the direct-type panel lamp 100 is in the installed state, the height of the first convex rib 24 and the height of the second convex rib 25 refer to the respective lengths of the first convex rib 24 and the second convex rib 25 along the vertical direction, and the width direction of the first convex rib 24 and the width direction of the second convex rib 25 are perpendicular to the vertical direction.

In one of the embodiments, the second convex ribs 25 extend at intervals or continuously along the peripheral sides of the back plate 20. In the present embodiment, the second convex ribs 25 extend continuously along the peripheral sides of the back plate 20.

In order to provide the edge area 22 with a certain structural strength, in some embodiments, the distance L2 between the first convex ribs 24 and the edge of the back plate 20 ranges from 4 mm to 10 mm.

Preferably, the distance L2 between the first convex ribs 24 and the edge of the back plate 20 is 5 mm.

Considering the processing and heat dissipation, the back plate 20 is stamped from a sheet metal (such as ST13) to form an arched shell-like structure, so that a certain distance is formed between the back plate 20 and the diffusion plate 30, and thus the light bar 10 can be accommodated. In some embodiments, the back plate 20 is arched to form a chamber 23 comprising a flat bottom wall 231 and an inclined side wall 232, wherein the bottom wall 231 and the diffusion plate 30 are arranged in parallel. The at least one light bar 10 is fixed on the bottom wall 231. The side wall 232 is tangentially connected with the first convex ribs 24. The light bar 10 is installed on the bottom surface of the bottom wall 231.

In some embodiments, the portion of the edge area 22 overlapping the frame 40 is parallel to the bottom wall 231, and the bottom wall 231 is higher than the edge area 22. In the case where the direct-type panel lamp 100 is installed on the ceiling, the bottom wall 231 is arranged horizontally, and the corresponding portion of the edge area 22 overlapping the frame 40 is also arranged horizontally.

Figure 2:
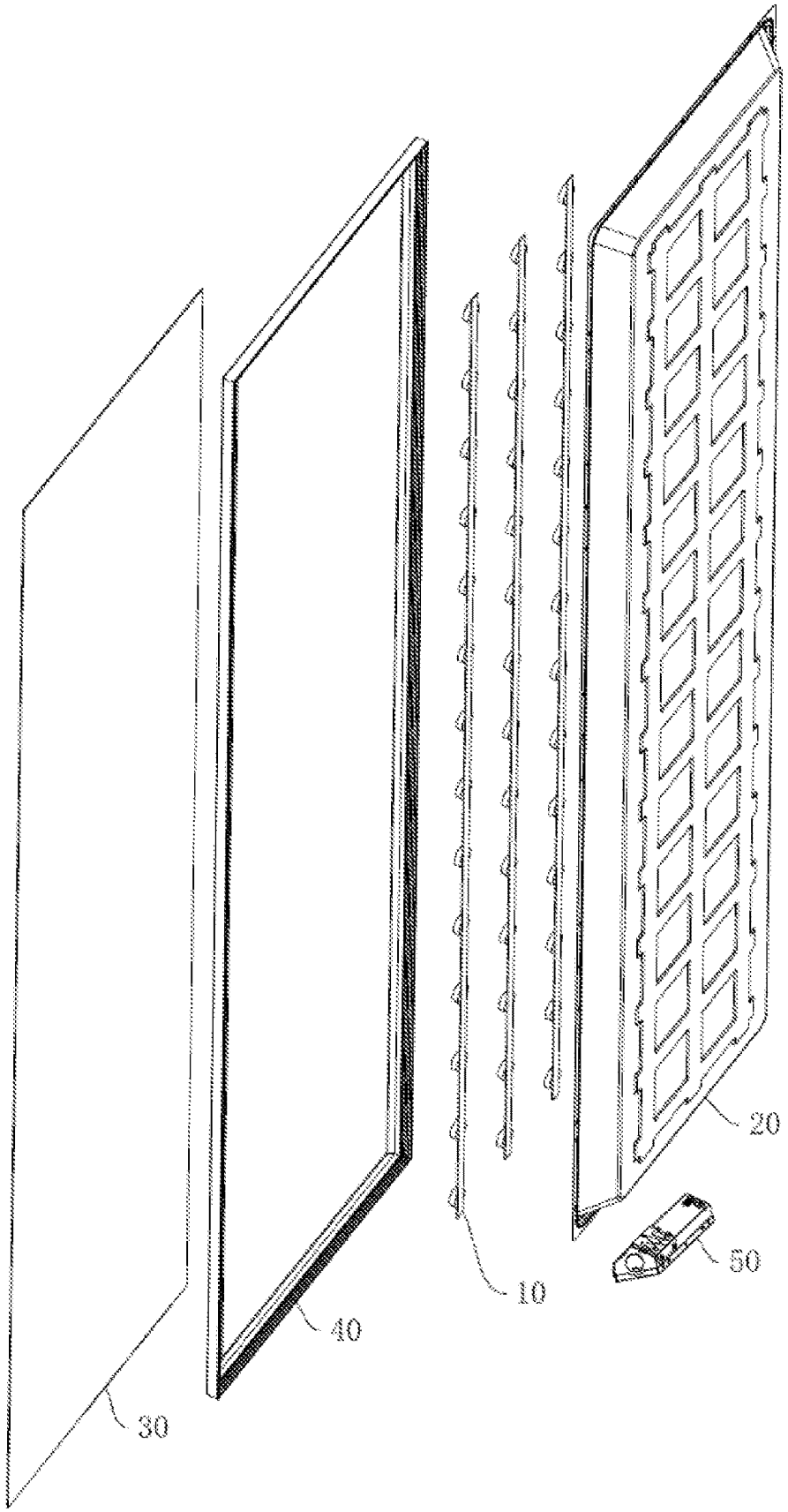
FIG. 2 is an exploded view of the direct-type panel lamp shown in FIG. 1.
Figure 3:
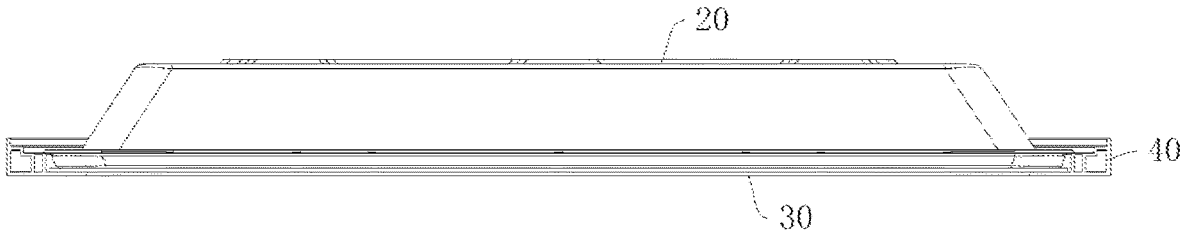
FIG. 3 is a structure view of FIG. 1 in which a frame bar is not shown.
Figure 4:
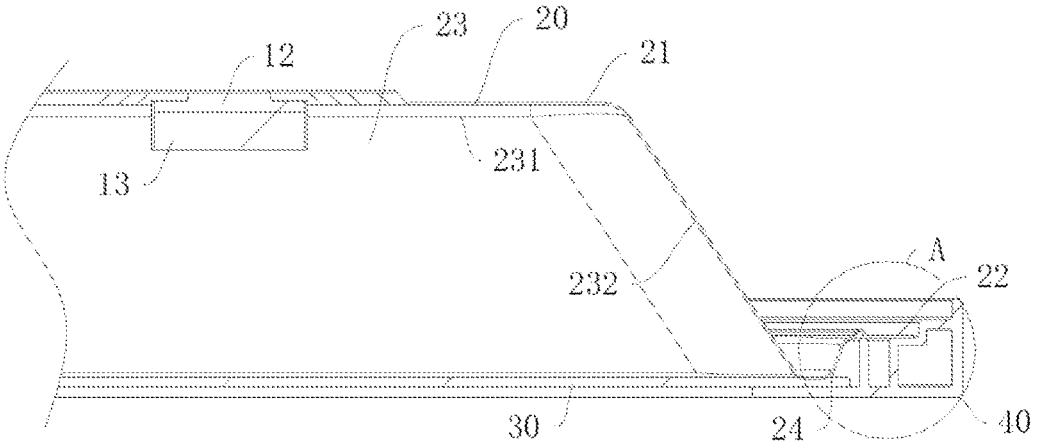
FIG. 4 is a partial view of the direct-type panel lamp shown in FIG. 1.
Figure 5:
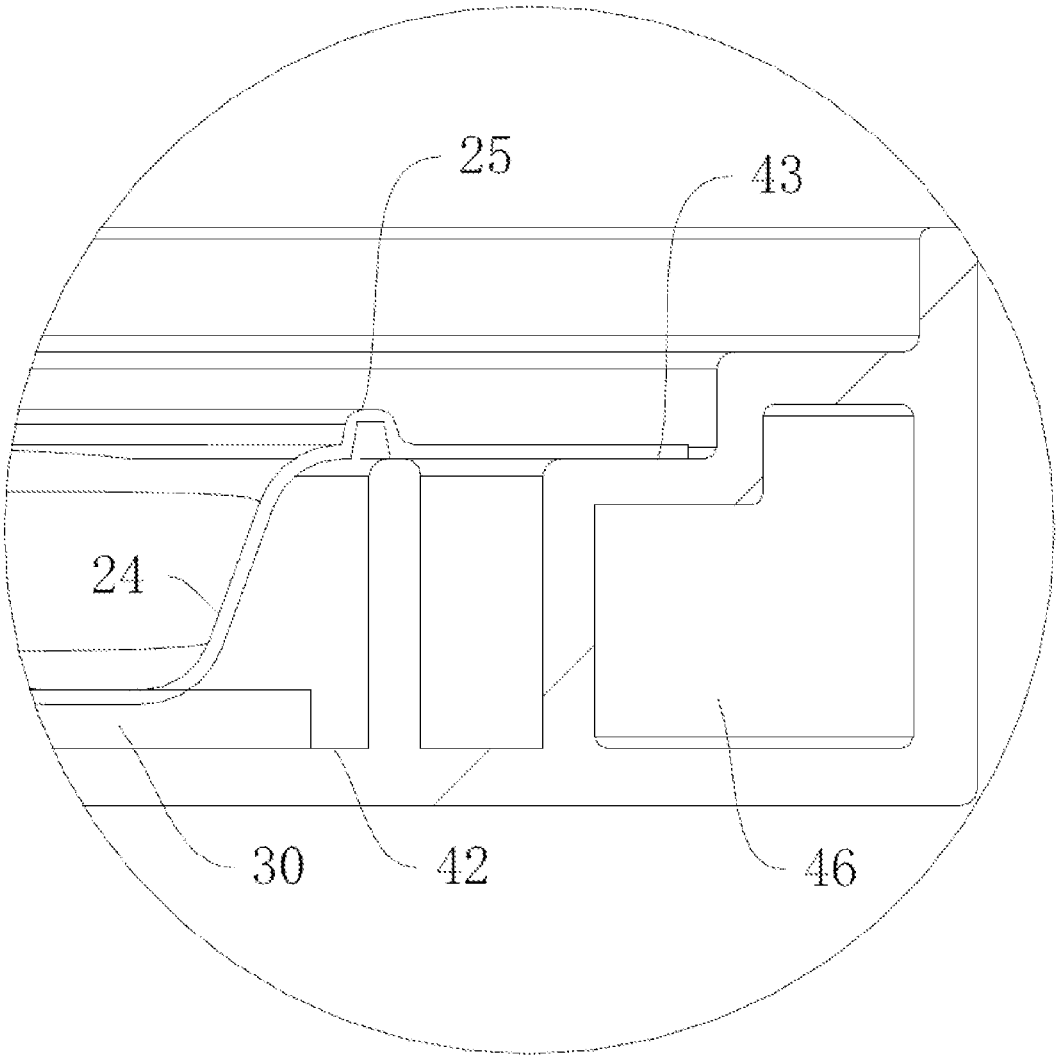
FIG. 5 is an enlarged view of the portion A shown in FIG. 4.
Figure 6:
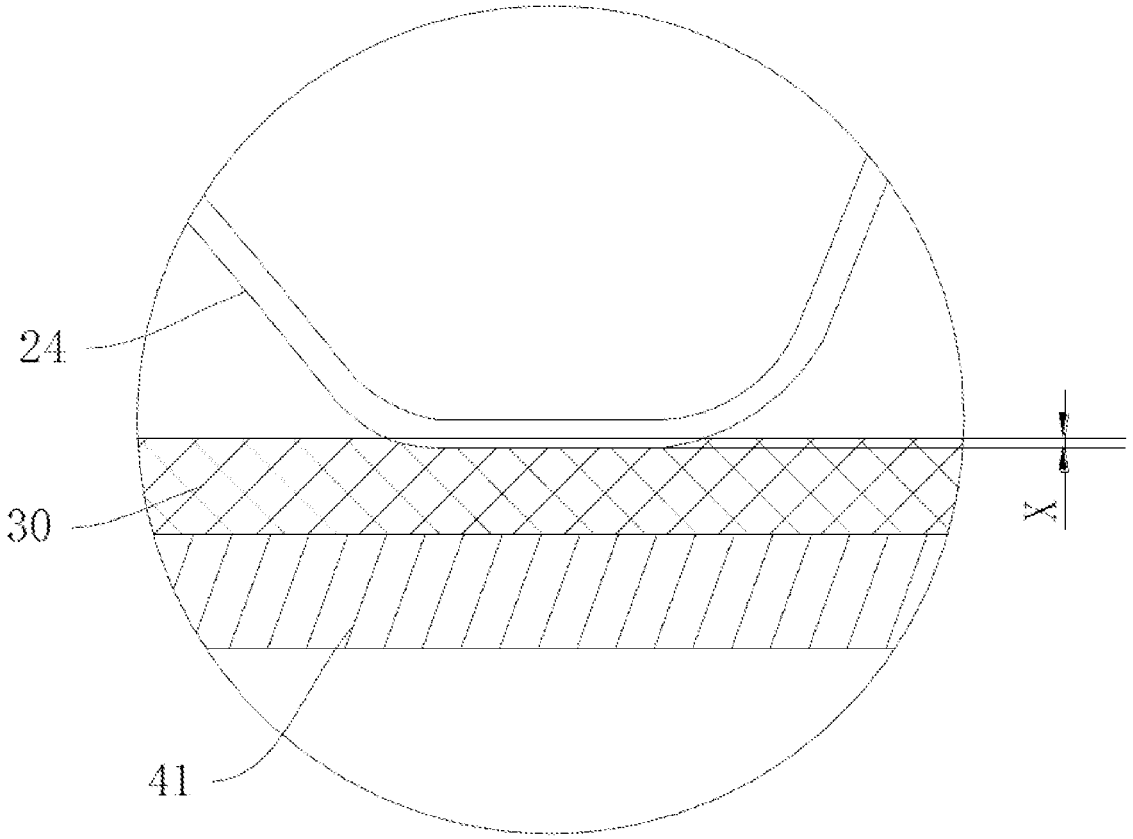
FIG. 6 is a structure view of the first convex rib and the frame.
Figure 7:
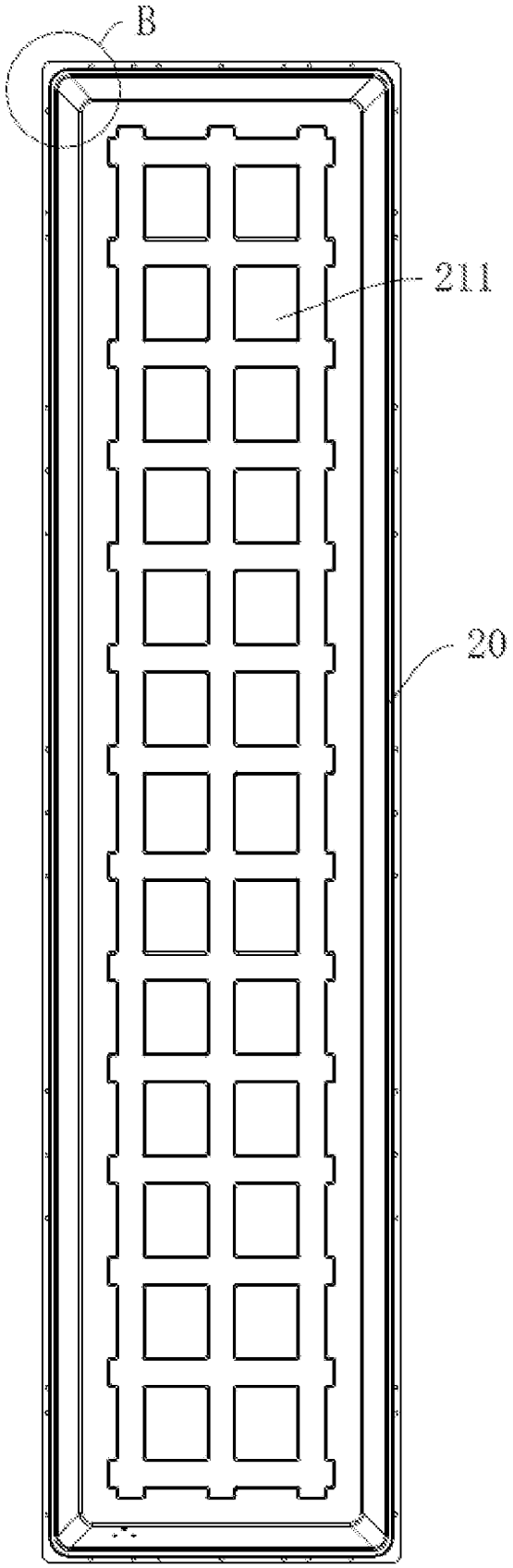
FIG. 7 is a structure view of the back plate shown in FIG. 1.

In order to facilitate the installation of the light bar 10, in some embodiments, as shown in FIGS. 1 and 2, the bottom wall 231 defines grooves arranged in a crisscross pattern for receiving the at least one light bar 10. In order to facilitate the processing of the grooves on the back plate 20, the center area 21 of the back plate 20 is stamped to form a plurality of protrusions 211 facing away from the chamber 23, and the grooves are formed between adjacent protrusions 211. Since the light bars 10 are all arranged in parallel, the protrusions 211 should also be arranged in parallel. The gap between two adjacent protrusions 211 functions to receive the light bar 10, so the light bar 10 generally has a straight bar structure. Alternatively, the light bar may also have a coiled structure.

In some embodiments, the edge area 22 of the back plate 20 is fixed on the frame 40 by fastening screws. For ease of installation, the frame bar 41 is provided with a screw groove 471 arranged along the longitudinal direction thereof. In some embodiments, the middle portion of the upper surface of the horizontal portion 44 is provided with a vertical portion 47, the gap between the vertical portion 47 and the stepped structure forms the screw groove 471, and the top surface of the vertical portion 47 supports the edge area 22.

In order to reduce the weight of the back plate 20 and provide the back plate 20 with sufficient supporting strength, in some embodiments, the thickness of the back plate 20 ranges from 0.2 mm to 0.4 mm. Preferably, the thickness of the back plate 20 is 0.3 mm.

The substrate 11 may be a metal substrate, preferably an aluminum substrate, or an FR-4 glass fiber substrate. In some embodiments, the surface of the substrate 11 is coated with white solder resist ink to improve light reflection efficiency. The substrate 11 may be fixed to the bottom surface of the back plate 20 by screws, and is preferably fixed to the bottom surface of the back plate 20 by thermally conductive glue.

In some embodiments, as shown in FIGS. 13 to 17, adjacent light bars 10 are connected in parallel by wires or flexible strips 14. The LED lamp beads 12 are distributed in a matrix form on the inner side of the back plate 20, so that the light sources are evenly distributed and at the same time easy to install.

In some embodiments, the substrate 11 includes a metal layer 111, an insulating layer 112 and a circuit layer 113, and the LED lamp beads 12 are soldered on the circuit layer 113. Solder pads 115 for welding the LED lamp beads 12 are usually provided on the circuit layer 113. In order to provide protection for the circuit layer 113, the surface of the substrate 11 is coated with white solder resist ink to form a solder resist layer 144, with openings formed at the solder pads 115 to expose the solder pads 115 for welding the LED lamp beads 12.

Lenses 13 of the light bar 10 mainly function to diffuse light. The lenses 13 are fixed on the substrate 11 by epoxy glue or UV glue. In order to facilitate installation, protruding legs 131 are provided on the back side of the lens 13, and positioning holes engaging with the protruding legs 131 are provided on the corresponding substrate 11.

In some embodiments, the flexible strip 14 is pressed on all the light bars 10 and perpendicularly intersects all the light bars 10 to facilitate the welding of the light bars 10 and the flexible strip 14. The flexible strip 14 has a strip-shaped structure and includes an insulating layer 142, a circuit layer 143 and a solder resist layer 144. The insulating layer 142 is made of insulating resin material. The solder resist layer 144 is formed by white solder resist ink coated on the surface, so that the flexible strip 14 can also reflect light.

In order to connect the flexible strip 14 and the substrate 11, first openings 141 are defined at the edges of the flexible strip 14 that are not coated with solder resist ink, and second openings 114 are defined at the positions of the substrate 11 close to the flexible strip 14 that are not coated with solder resist ink, with solder pads provided at first and second openings that are electrically connected by welding.

In order to improve the reflection effect, the bottom surface of the back plate 20 is provided with a white reflective coating. The reflective coating may be formed using various metal coating materials, including epoxy resin, UV resin, and the like.

Figure 8:
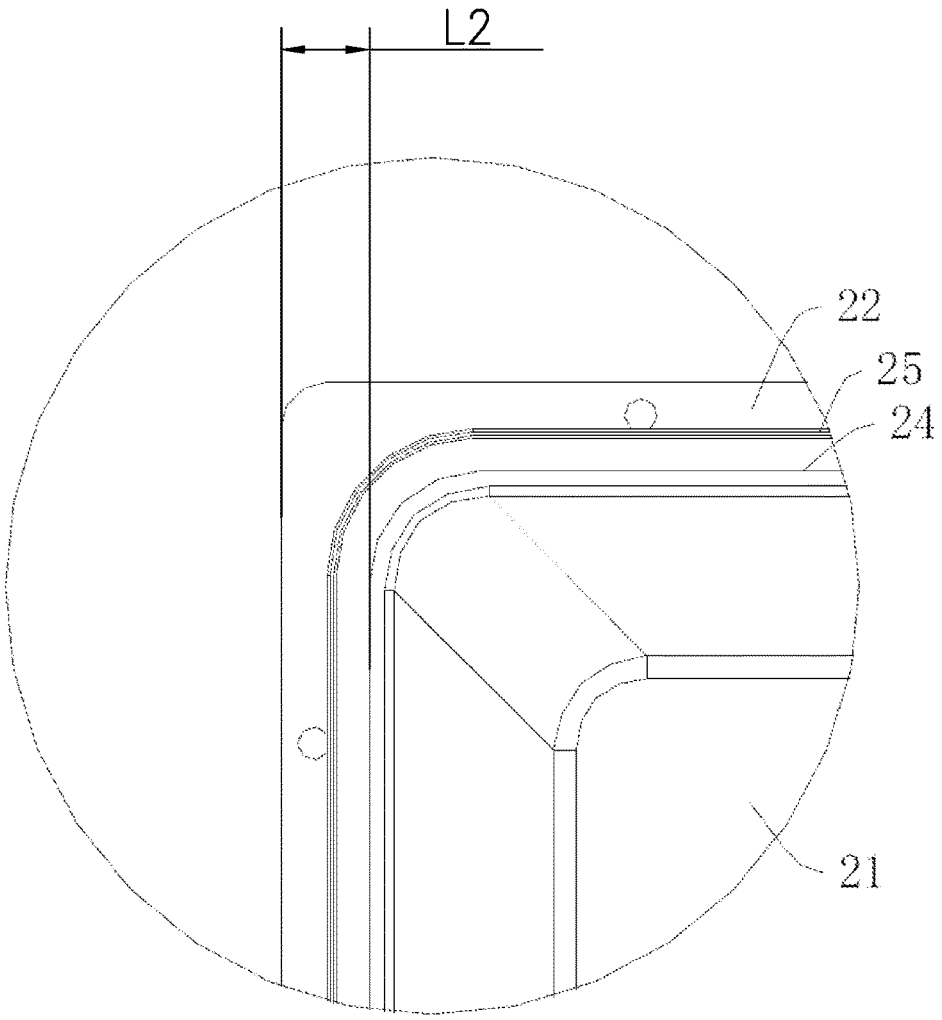
FIG. 8 is an enlarged view of the portion B shown in FIG. 7.
Figure 9:
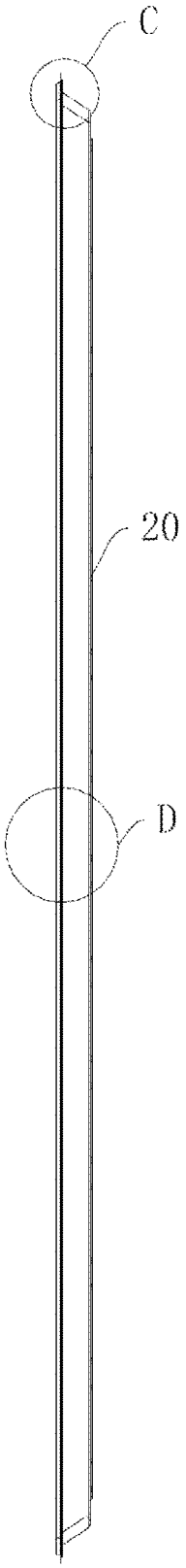
FIG. 9 is a structure view of the back plate shown in FIG. 1.
Figure 10:
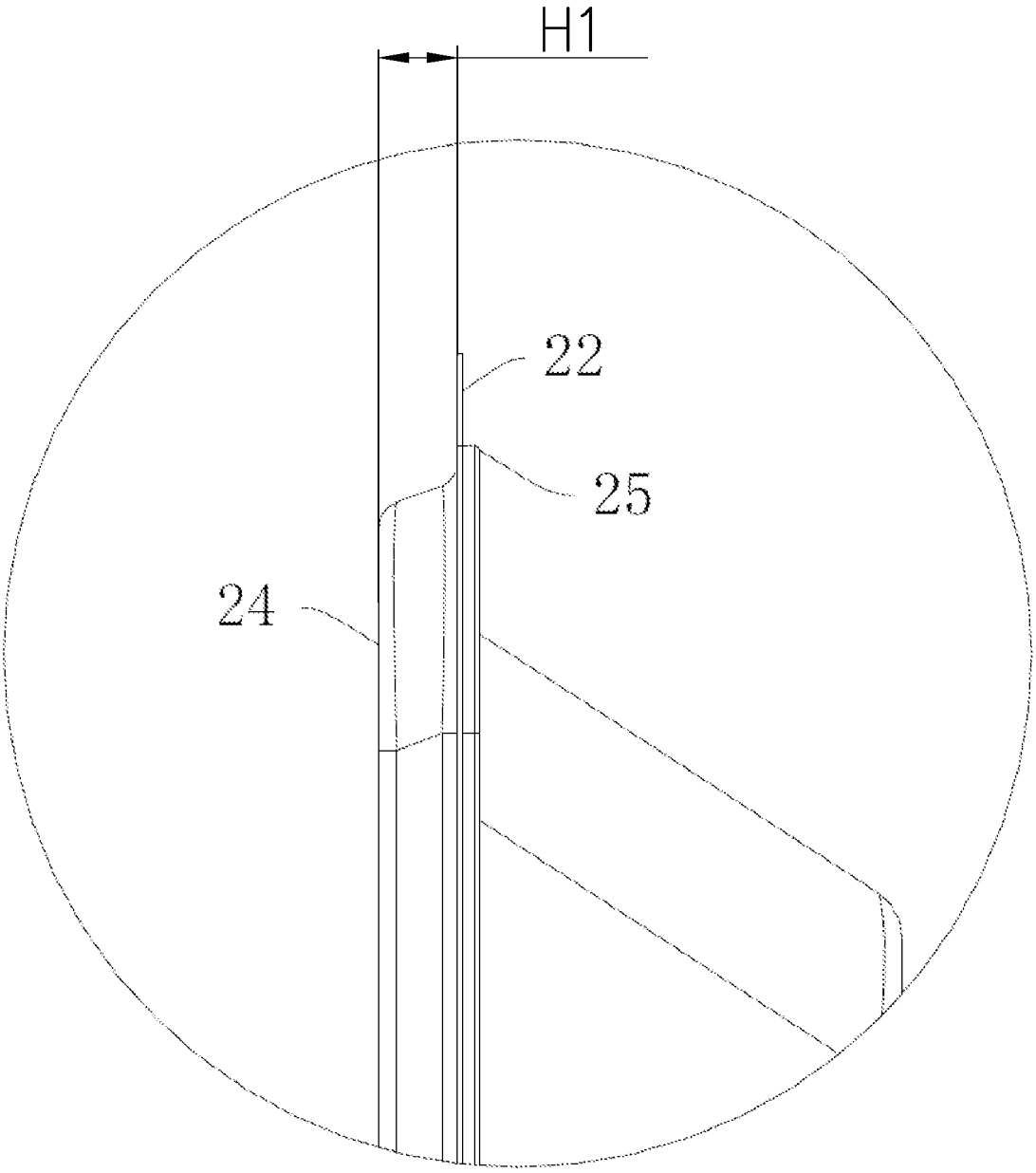
FIG. 10 is an enlarged view of the portion C shown in FIG. 9.
Figure 19:
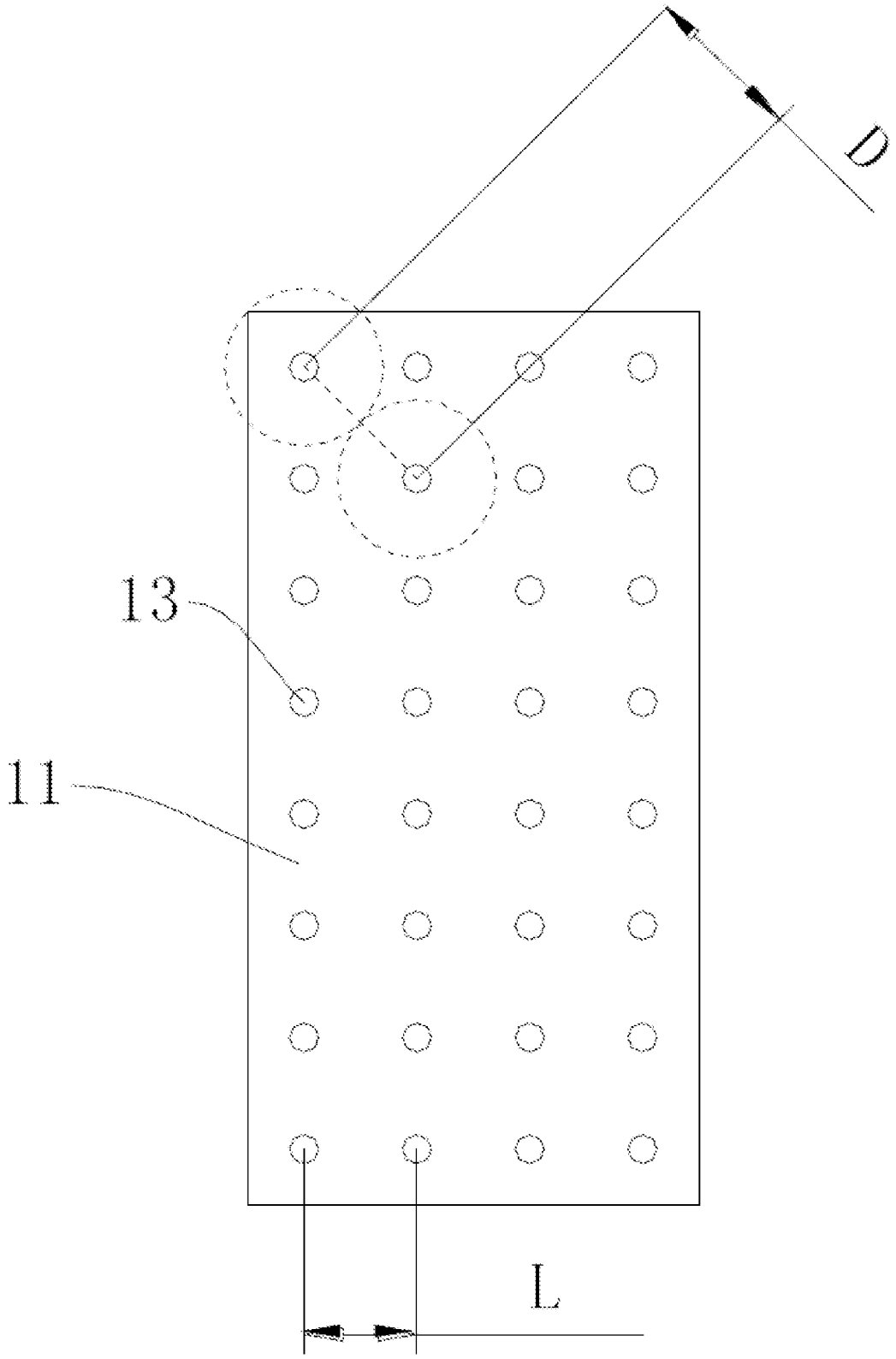
FIG. 19 is a structure view showing the light emitted by the LED lamp beads passing through the lenses and being diffused.

The light passes through the lens 13 and projects on the diffusion plate 30 to form a circular light spot. In order to allow the light to be uniformly diffused, the light spots should cover the entire diffusion plate 30. As shown in FIGS. 8 and 19, the diameter D of the light spot is not less than the distance between the two adjacent LED lamp beads 12 on the same diagonal. Because the intensity of the light spot is large in the middle portion thereof and small in the edge portion thereof, the adjacent light spots are partially overlapped, so that the light from the diffusion plate 30 is approximately uniform.

Provided that the beam angle of the lens 13 is R, and the vertical distance between the LED lamp bead 12 and the diffusion plate 30 is d, in the case where all points of the diffusion plate 30 are projected by light, the relationship $$L \geq \sqrt{2}\,\mathrm{tag}\frac{R}{2}\cdot d$$

should be satisfied.

It can be concluded that in the case where the thickness of the panel lamp is determined, the greater the beam angle R of the lens 13 is, the longer the distance between the LED lamp beads 12 can be provided, that is, the number of the arranged LED lamp beads 12 can be smaller.

In some of the embodiments, the beam angle of the lens 13 is 168°, and generally should not be less than 160°, so that the thickness of the panel lamp can reach 20-30 mm, and the distance between the LED lamp beads 12 can reach 50-80 mm.

To enable the direct-type panel lamp 100 to normally operate, direct-type panel lamp 100 is provided with a driving module, and the flexible strip 14 is electrically connected to the driving module via wires. In order to fix and protect the driving module, the driving module is usually arranged in a driving box 50.

In order to facilitate the packaging and transportation of the direct-type panel lamp 100, the driving box 50 is arranged in the gap between the back plate 20 and the vertical portion 45, and the top surface of the driving box 50 is lower than the top surface of the back plate 20 or the vertical portion 45, so that the driving box 50 would not be exposed outside, and thus an external force can be prevented from exerting on the driving box 50.

In order to facilitate the assembly of the driving box 50, the driving box 50 is also fixed in the gap by the fastening screws screwed into the screw groove 471. The driving box 50 includes a box body with an opening, and a top cover snap-fit at the opening of the box body. The driving module is placed in the box body, and two ends of the box body are provided with wire openings for the connection wires of the driving module to pass through. In the case where the driving module needs to be replaced or repaired, it is only required to take the driving module out of the box body, which simplifies the maintenance or replacement of the driving module.

Two ends of the box body are provided with tabs extending toward the outside of the box body, and the tabs are fixed on the frame 40 by fastening screws, and the bottom surfaces of the tabs are flush with the bottom surface of the box body. In order to reduce the difficulty of processing the junction between the tabs and the box body, and to enhance the structural connection strength between the tabs and the box body at the same time, the tabs and the box body are formed in one piece.

Figure 20:
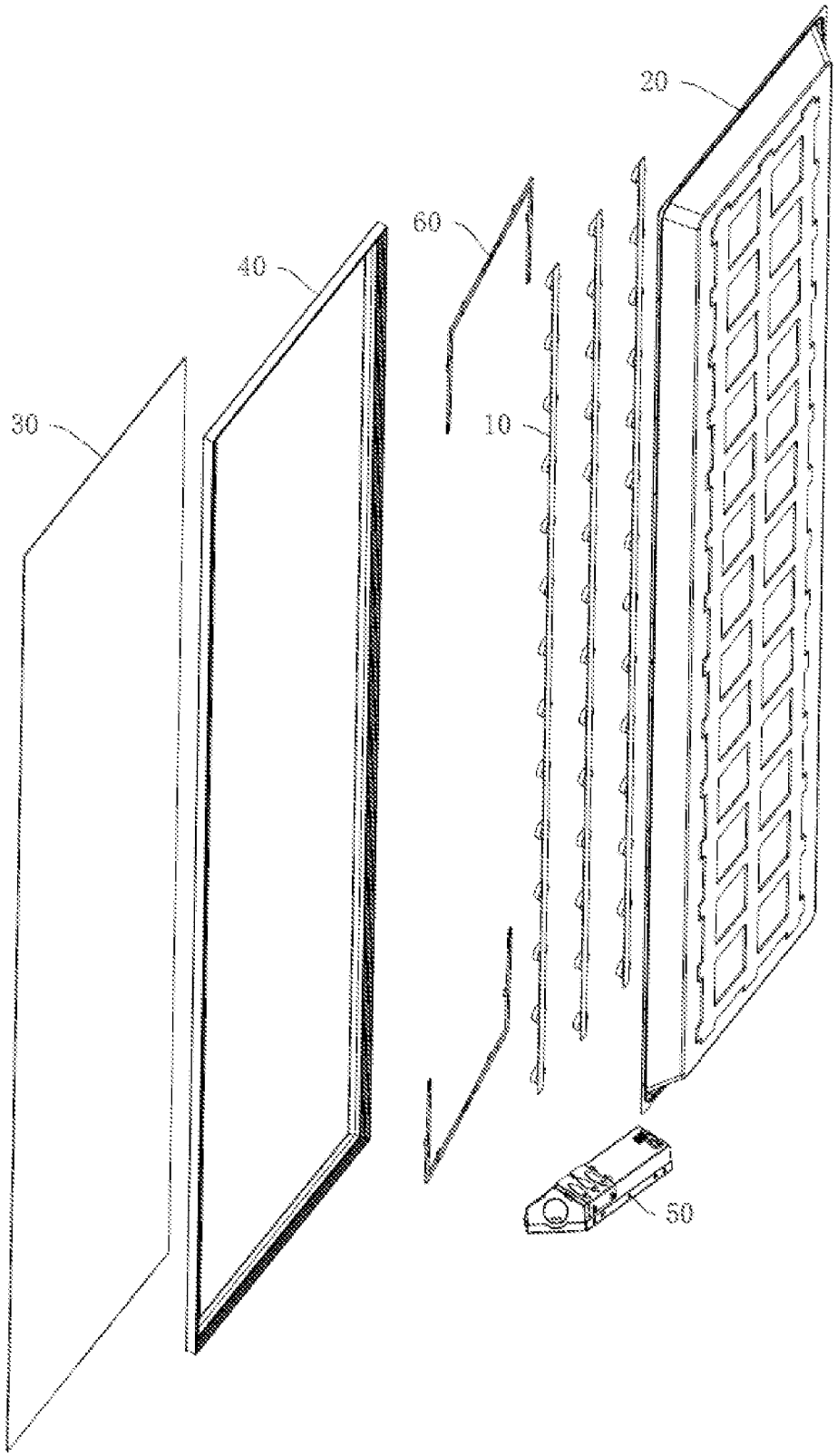
FIG. 20 is an exploded view of another embodiment of a direct-type panel lamp.
Figure 22:
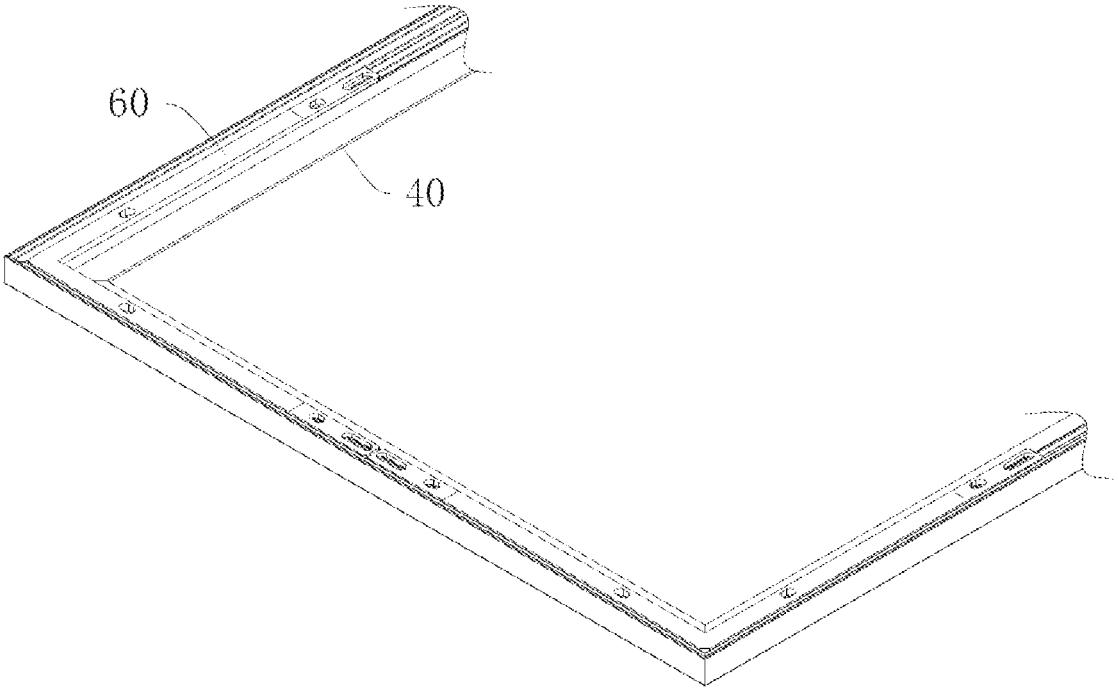
FIG. 22 is a structure view showing the compensation bar matching with the frame.

In some embodiments, as shown in FIG. 20 and FIG. 22, the direct-type panel lamp 100 further includes a compensation bar 60. The compensation bar 60 is arranged between the edge area 22 and the second mounting surface 43, and close to the corner of the frame 40. The thickness of the compensation bar 60 gradually decreases from the respective end to the center of the frame bar 41. The compensation bar 60 lifts the edge area 22 (to increase the distance of the gap between the edge area 22 and the frame bar 41), in order to counteract the warpage caused by the unflattened bottom edge of the back plate 20, and to prevent the back plate 20 from pulling and thus deforming the frame 40, so that the direct-type panel lamp 100 can be closely attached to the keel on the ceiling, without gap therebetween.

Figure 21:
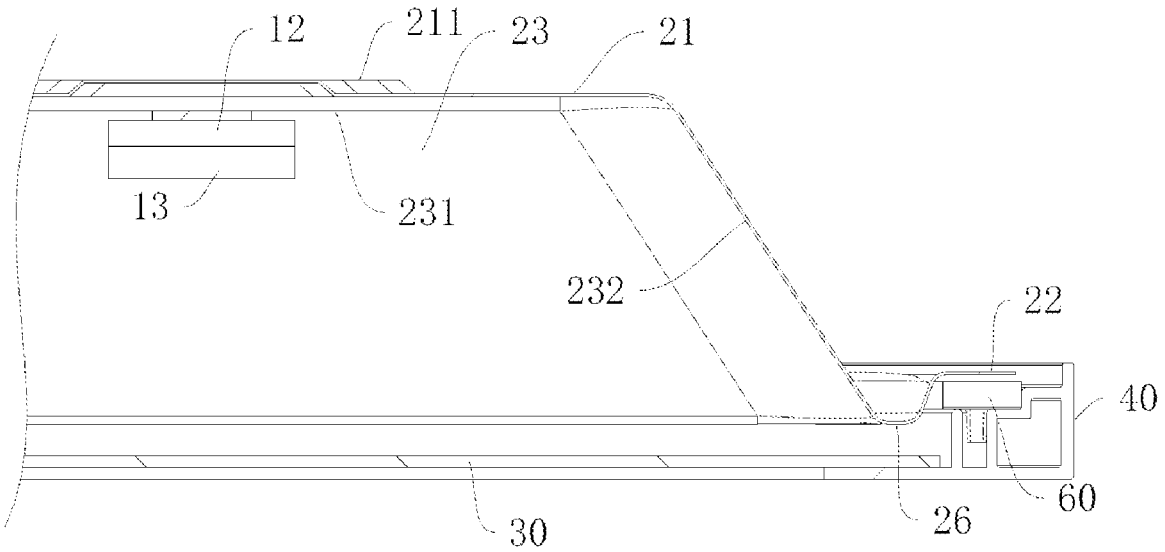
FIG. 21 is a partial structure view of the direct-type panel lamp in FIG. 20.

Similarly, in order to solve the problem of the deformation of the frame, as shown in FIG. 21, the edge area 22 of the back plate 20 is deformed and forms a convex rib 26 extending along the peripheral sides of the back plate 20, the convex rib 26 can increase the supporting strength of the entire back plate 26, especially the supporting strength of the edge area 22. The edge area 22 is bent using conventional processing methods, such as mechanical stamping or the like.

The other details or alternatives of the convex ribs 26 may refer to the first convex ribs 24 and the second convex ribs 25 in the foregoing embodiment.

In order to reduce the weight of the compensation bar 60, in one of the embodiments, the compensation bar 60 is made of plastic material such as polyvinyl chloride. Alternatively, in other embodiments, the compensation bar 60 may be made of metal such as aluminum or ENA cotton or the like.

Figure 23:
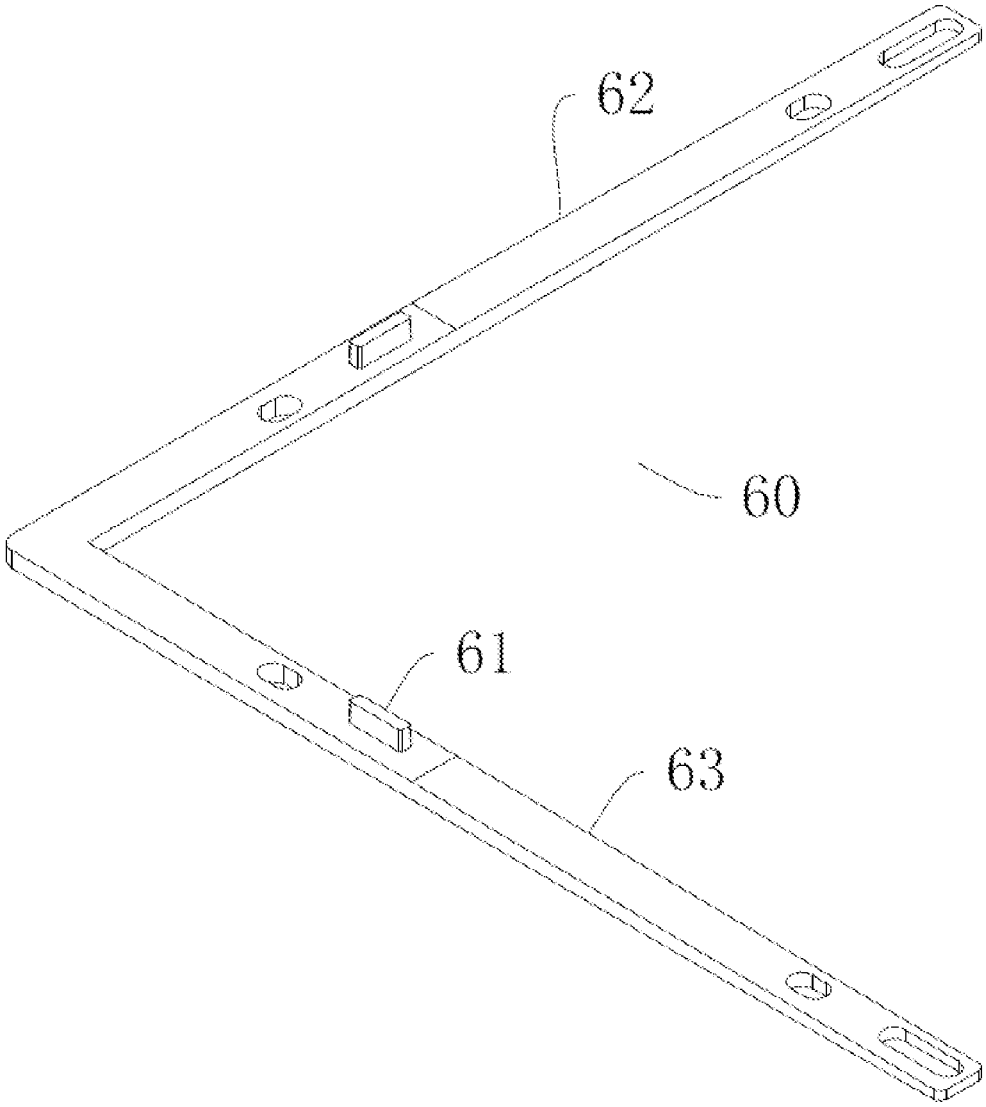
FIG. 23 is a structure view of the compensation bar in FIG. 22.

In order to simplify the installation of the compensation bar 60 on the frame 40, in some embodiments, as shown in FIG. 23, one of the compensation bar 60 and the frame 40 is provided with a positioning groove, the other is provided with a positioning pin 61 that is matched with the positioning groove. Through the engagement between the positioning pin 61 and the positioning groove, the compensation bar 60 can be quickly installed at a predetermined position of the frame 40.

In order to prevent the compensation bar 60 from moving after it is installed on the frame 40, in some embodiments, the outer contour of the positioning pin 61 generally corresponds to the contour of the positioning groove. In the case where the number of the positioning pin 61 is one, the cross section of the positioning pin 61 is non-circular (for example, in the present embodiment, the cross section of the positioning pin 61 is oval). Alternatively, in the case where the number of positioning pins 61 is at least two, the cross section of positioning pins 61 is not strictly limited.

In some embodiments, the compensation bar 60 is L-shaped, and includes a first compensation portion 62 and a second compensation portion 63. The junction between the first compensation portion 62 and the second compensation portion 63 is aligned with the junction of two adjacent frame bars 41, and the first compensation portion 62 and the second compensation portion 63 respectively extends toward the center of the frame bars 41. The thickness of the first compensation portion 62 and the thickness of the second compensation portion 63 both gradually decrease from the end of the respective frame bars to the center of the respective frame bars.

The first compensation portion 62 and the second compensation portion 63 may formed in one piece, which can simplify the processing of the compensation bar 60 and increase the structural strength of the compensation bar 60. Alternatively, in other embodiments, the first compensation portion 62 and the second compensation portion 63 may formed in separate pieces.

To enable the positioning pin 61 to engage with the positioning groove more closely, in some embodiments, the positioning pin 61 has a longitudinal direction, and gradually tapers from one end to the other end along the longitudinal direction, wherein the larger end of the positioning pin 61 is connected to the compensation bar or the frame bar. When the smaller end of the positioning pin 61 is inserted into the positioning slot, the side walls of the positioning pin 61 can be attached to at least two inner walls of the positioning slot.

In order to further facilitate the positioning of the compensation bar 60 on the frame 40, in some embodiments, the positioning pins 61 are provided on the compensation bar 60, the number of the positioning pins 61 is at least two, and the positioning pins 61 are arranged in sequence along the extension direction of the compensation bar 60.

The positioning pin 61 and the compensation bar 60 may be connected by bonding or welding or the like. In order to strengthen the connection strength between the positioning pin 61 and the compensation bar 60 and simplify the processing of the junction between the positioning pin 61 and the compensation bar 60, in one of the embodiments, the positioning pin 61 and the compensation bar 60 are formed in one piece.

The included angle between the top surface and the bottom surface of the compensation bar 60 ranges from 1 degree to 5 degrees, wherein, the top surface of the compensation bar 60 is the surface in contact with the edge area 22, and the bottom surface of the compensation bar 60 is the surface in contact with the second mounting surface 43. Preferably, the included angle between the top surface and the bottom surface of the compensation bar 60 ranges from 1 degree to 2 degrees.

The greatest thickness of the compensation bar 60 is provided as H1, and the smallest thickness is provided as H2, and wherein H1 and H2 meet H1: H2=1.1-2. In the present embodiment, the greatest thickness of the compensation bar 60 is 2.5 mm, the smallest thickness is 1.5 mm, and the width is 7 mm.

In order to simplify the processing of the screw groove 471 and the positioning groove, in some embodiments, the screw groove 471 is configures as the positioning groove, and the fastening screw for fixing the back plate 20 passes through the edge area 22 and the compensation bar 60 in sequence.

The compensation bar can counteract the warping caused by the unflattened bottom edge of the back plate, and avoid the back plate from pulling and thus deforming the frame thus the direct-type panel lamp can be closely attached to keel on the ceiling, without gap therebetween.

The technical features of the above embodiments can be combined arbitrarily. To make the description concise, all possible combinations of the technical features in the above embodiments are not described. However, as long as there is no contradiction in the combination of these technical features, it should be regarded as within the scope of this specification. When the technical features of different embodiments are reflected in the same drawing, it can be regarded that the drawing also discloses the combination examples of the various embodiments involved.

The above examples only express several implementations of the application, and the descriptions are more specific and detailed, but they should not be interpreted as a limitation on the scope of the patent application. It should be pointed out that for those of ordinary skill in the art, without departing from the concept of this application, several modifications and improvements can be made, and these all fall within the protection scope of this application.

What is claimed is:

1. A direct-type panel lamp, comprising:

at least one light bar comprising a substrate and LED lamp beads fixed on the substrate;

a frame comprising several frame bars that are connected to one another, each frame bar having a first mounting surface and a second mounting surface that are located at different levels;

a diffusion plate for transmitting light, wherein an edge of the diffusion plate is overlapped on the first mounting surface at a lower level; and a back plate having a shell-like structure formed by deforming a sheet metal, wherein an edge area of the back plate is overlapped on the second mounting surface at a higher level, and a central area of the back plate is protruded away from the second mounting surface, wherein the at least one light bar is fixed to the central area, and wherein the edge area of the back plate is deformed and forms first convex ribs extending along peripheral sides of the back plate, the first convex ribs abut against the edge of the diffusion plate and press it against the first mounting surface, and each first convex rib has a height gradually increasing from a middle towards two opposite ends thereof in a direction along a perimeter of the back plate.

2. The direct-type panel lamp according to claim 1, wherein two first convex ribs located on adjacent peripheral sides of the back plate are connected with each other.

3. The direct-type panel lamp according to claim 1, wherein the highest height of the first convex rib is provided as H1, and the lowest height is provided as H2, and wherein H1 and H2 meet H1: H2=1.0~1.1:1.

4. The direct-type panel lamp according to claim 1, wherein a distance L2 between the first convex rib and an edge of the back plate ranges from 4 mm to 10 mm.

5. The direct-type panel lamp according to claim 1, wherein the back plate is protruded away from the second mounting surface to form a chamber comprising a bottom wall and an inclined side wall, wherein the bottom wall and the diffusion plate are arranged in parallel, the at least one light bar is fixed on the bottom wall, and the side wall is tangentially connected with the first convex ribs.

6. The direct-type panel lamp according to claim 5, wherein the bottom wall defines grooves arranged in a crisscross pattern for receiving the at least one light bar.

7. The direct-type panel lamp according to claim 1, wherein the edge area of the back plate forms second convex ribs extending along each of the peripheral sides of the back plate respectively, the first convex rib and the second convex rib along each peripheral side of the back plate are arranged in parallel with one another, and each of the second convex ribs is located outside a corresponding first convex rib.

8. The direct-type panel lamp according to claim 7, wherein the edge area of the back plate is bent to form the first convex ribs and the second convex ribs.

9. The direct-type panel lamp according to claim 1, wherein an interference fit X between the first convex rib and the diffusion plate is less than 0.5 mm.

10. The direct-type panel lamp according to claim 9, wherein the interference fit X between the first convex rib and the diffusion plate is less than 0.3 mm.

11. The direct-type panel lamp according to claim 1, wherein a cross-section of the frame bar is an L-shaped structure, which comprises a horizontal portion and a vertical portion, and the horizontal portion has a stepped structure such that the horizontal portion forms the first mounting surface and the second mounting surface that are located at different levels.

12. A direct-type panel lamp, comprising:

at least one light bar comprising a substrate and LED lamp beads fixed on the substrate;

a frame comprising several frame bars that are connected to one another, each frame bar having a first mounting surface and a second mounting surface that are located at different levels;

a diffusion plate for transmitting light, wherein an edge of the diffusion plate is overlapped on the first mounting surface at a lower level;

a back plate having a shell-like structure formed by deforming a sheet metal, wherein an edge area of the back plate is overlapped on the second mounting surface at a higher level, and a central area of the back plate is protruded away from the second mounting surface, wherein the at least one light bar is fixed to the central area, and wherein the edge area of the back plate is deformed and forms first convex ribs extending along peripheral sides of the back plate, the first convex ribs abut against the edge of the diffusion plate and press it against the first mounting surface, and wherein the edge area of the back plate forms second convex ribs extending along each of the peripheral sides of the back plate respectively, the first convex rib and the second convex rib along each peripheral side of the back plate are arranged in parallel with one another, and each of the second convex ribs is located outside a corresponding first convex rib.

13. The direct-type panel lamp according to claim 12, wherein the highest height of the first convex rib is provided as H1, and the lowest height is provided as H2, and wherein H1 and H2 meet H1: H2=1.02~1.1:1.

14. The direct-type panel lamp according to claim 12, wherein a distance L2 between the first convex rib and an edge of the back plate ranges from 4 mm to 10 mm.

15. The direct-type panel lamp according to claim 12, wherein the back plate is protruded away from the second mounting surface to form a chamber comprising a bottom wall and an inclined side wall, wherein the bottom wall and the diffusion plate are arranged in parallel, the at least one light bar is fixed on the bottom wall, and the side wall is tangentially connected with the first convex ribs.

16. The direct-type panel lamp according to claim 15, wherein the bottom wall defines grooves arranged in a crisscross pattern for receiving the at least one light bar.

17. The direct-type panel lamp according to claim 12, wherein the edge area of the back plate is bent to form the first convex ribs and the second convex ribs.

18. The direct-type panel lamp according to claim 12, wherein an interference fit X between the first convex rib and the diffusion plate is less than 0.5 mm.

19. The direct-type panel lamp according to claim 12, wherein a cross-section of the frame bar is an L-shaped structure, which comprises a horizontal portion and a vertical portion, and the horizontal portion has a stepped structure such that the horizontal portion forms the first mounting surface and the second mounting surface that are located at different levels.

20. A direct-type panel lamp, comprising:

at least one light bar comprising a substrate and LED lamp beads fixed on the substrate;

a frame comprising several frame bars that are connected to one another, each frame bar having a first mounting surface and a second mounting surface that are located at different levels;

a diffusion plate for transmitting light, wherein an edge of the diffusion plate is overlapped on the first mounting surface at a lower level;

a back plate having a shell-like structure formed by deforming a sheet metal, wherein an edge area of the back plate is overlapped on the second mounting surface at a higher level, and a central area of the back plate is protruded away from the second mounting surface, wherein the at least one light bar is fixed to the central area, and wherein the edge area of the back plate is deformed and forms first convex ribs extending along peripheral sides of the back plate, the first convex ribs abut against the edge of the diffusion plate and press it against the first mounting surface, and the first convex rib on each peripheral side of the back plate has a height gradually increasing from a middle thereof towards two ends thereof, respectively, and wherein the edge area of the back plate forms second convex ribs extending along each of the peripheral sides of the back plate respectively, the first convex rib and the second convex rib along each peripheral side of the back plate are arranged in parallel with one another, and each of the second convex ribs is located outside a corresponding first convex rib.

* * * * *